US006022680A

United States Patent [19]

Yamanouchi et al.

[11] Patent Number: 6,022,680

[45] Date of Patent: Feb. 8, 2000

[54] SILVER HALIDE COLOR PHOTOGRAPHIC LIGHT-SENSITIVE MATERIAL

[75] Inventors: Junichi Yamanouchi; Masashi Ogiyama; Osamu Takahashi, all of Minami Ashigara, Japan

[73] Assignee: Fuji Photo Film Co., Ltd., Minami Ashigara, Japan

[21] Appl. No.: 08/872,668

[22] Filed: Jun. 11, 1997

[30] Foreign Application Priority Data

Jun. 11, 1996 [JP] Japan ..... 8-149534

[51] Int. Cl.[7] ..... G03C 1/08; G03C 7/26; G03C 7/32

[52] U.S. Cl. ..... 430/551; 430/502; 430/543; 430/552; 430/553; 430/627; 430/631; 430/634; 430/531; 430/536

[58] Field of Search ..... 430/502, 543, 430/532, 533, 627, 631, 634, 531, 536

[56] References Cited

U.S. PATENT DOCUMENTS

| | | | |
|---|---|---|---|
| 3,287,289 | 11/1966 | Renm et al. | 430/393 |
| 3,706,561 | 12/1972 | Mowrey et al. | 430/393 |
| 3,773,510 | 11/1973 | Flsch | 430/393 |
| 4,366,233 | 12/1982 | Nakamura | 430/393 |
| 4,374,922 | 2/1983 | Ohbayashi et al. | 430/383 |
| 4,591,546 | 5/1986 | West et al. | 430/270.1 |
| 4,591,548 | 5/1986 | Delprato | 430/553 |
| 4,914,005 | 4/1990 | Lau et al. | 430/553 |
| 5,015,562 | 5/1991 | Toya et al. | 430/634 |
| 5,026,631 | 6/1991 | Yoneyama | 430/545 |
| 5,302,501 | 4/1994 | Tamura et al. | 430/627 |
| 5,352,571 | 10/1994 | Suzuki et al. | 430/545 |
| 5,753,422 | 5/1998 | Shibahara et al. | 430/631 |

FOREIGN PATENT DOCUMENTS

| | | |
|---|---|---|
| 0294104 | 12/1988 | European Pat. Off. . |
| 2289840 | 11/1990 | Japan . |

*Primary Examiner*—Geraldine Letscher
*Attorney, Agent, or Firm*—Birch, Stewart, Kolasch & Birch, LLP

[57] ABSTRACT

A silver halide color photographic light-sensitive material comprising a support having provided thereon at least one silver halide emulsion layer, wherein the silver halide emulsion layer contains at least one cyan dye forming coupler and at least one polymer latex represented by the following formula (I):

$$—(A)_x—(B)_y— \quad (I)$$

wherein A represents a repeating unit derived from at least one ethylenically unsaturated monomer having at least one —COOM group (wherein M represents a hydrogen atom or a cation) in its molecule; B represents a repeating unit derived from at least one ethylenically unsaturated monomer which does not have the —COOM group; and x and y represent weight percentages of A and B, respectively, x represents a number of from 25 to 85, y represents a number of from 75 to 15, and x+y=100.

The silver halide color photographic light-sensitive material is excellent in rapid processing suitability and provides a color photograph having an excellent image quality in which degradation of color balance does not occur with the lapse of time after processing since the blix discoloration of cyan image in that the cyan dye formed by color development turns into its leuco-body in a bleaching or blixing solution is substantially prevented.

7 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material (hereinafter simply referred to as a light-sensitive material sometimes), more particularly to a silver halide color photographic light-sensitive material which is excellent in rapid processing suitability and which is prevented from color density decreasing due to the conversion of cyan image forming dye to its leuco-body in a bleaching solution or a bleach-fixing solution.

BACKGROUND OF THE INVENTION

In order to form color photographic images, a photographic material containing three kinds of photographic color couplers of yellow, magenta and cyan incorporated into three light-sensitive layers thereof having spectral sensitivities different from each other, respectively is exposed imagewise and then processed with a color developing solution containing a color developing agent. In this process, the couplers react with the oxidation products of aromatic primary amine developing agents to yield colored dyes.

In general, the standard steps of processing silver halide color photographic materials are composed of a color development step for forming color images, a desilvering step for removing developed silver and undeveloped silver, and a water washing step and/or an image stabilizing step.

The desilvering step for removing developed silver and silver halide described above comprises reoxidation of developed silver with an oxidizing agent and fixation using a silver halide solubilizing agent. The step can be conducted by successive two steps separately employing a bleaching solution, or by one step using a single solution containing both a bleaching agent and a fixing agent. The latter solution is ordinarily called a bleach-fixing solution or a blixing solution. While it is known that various oxidizing agents can be employed as the silver oxidizing agents in the bleaching solution or bleach-fixing solution described above, a metal complex salt of an organic acid, for example, a ferric complex salt of ethylenediaminetetracetic acid is usually used in view of low toxicity and environmental safety.

However, when the ferric complex salt described above is used as the bleaching agent for color photography, a cyan dye image having a sufficient density can not be obtained in some cases. This phenomenon is generally recognized as reduction discoloration resulted from conversion of the cyan dye to its leuco-body in the bleaching or bleach-fixing solution (hereinafter referred to as blix discoloration sometimes). In U.S. Pat. No. 4,591,548, it is pointed out that the conversion of the cyan dye to its leuco-body is caused by the presence of ferrous ions in the bleaching solution or bleach-fixing solution.

On the other hand, reduction of processing time has been hitherto sought. Recently, however, necessity for shortening the processing time increases more and more because of requirements on reduction of the period to finish, simplification of laboratory work, and miniaturization and simple operation of the processing system for small scale laborations which are designated so-called mini-labs.

The reduction of processing time for the color development step can be achieved by using a coupler having a high coupling speed, using a silver halide emulsion having a high developing speed, using a color developing solution having a high developing activity, using a color developing solution of high temperature or an appropriate combination thereof.

For the reduction of processing time for the desilvering step, decreasing a pH of the bleaching solution or bleach-fixing solution is effective. However, the decreasing a pH of the bleaching solution or bleach-fixing solution is accompanied with the problem in that the blix discoloration of cyan dye described above is accelerated.

In order to overcome the blix discoloration of cyan dye, various proposals have been made. For instance, the variation of concentrations or compositions of the bleaching solution or bleach-fixing solution is described to solve the problem, for example, in U.S. Pat. No. 3,706,561. In U.S. Pat. No. 4,366,233, to reduce the total amount of coated silver in layers positioned under the cyan dye forming layer of color photographic material is proposed. The addition of various compounds to the processing solution is described in U.S. Pat. No. 3,820,997. Also, the addition of a water-soluble ionic compound containing a polyvalent element to the bleach-fixing solution is proposed in U.S. Pat. No. 3,773,510.

In U.S. Pat. Nos. 4,151,680, 4,374,922 and 4,591,546, a group of cyan couplers preferred to solve the above described problem are described. Further, in JP-A-63-316857 (the term "JP-A" as used herein means an "unexamined published Japanese patent application"), the use of certain hydroquinone or quinone derivatives is described.

However, these known methods only have an insufficient effect, or have other problems in that the photographic properties, for example, image preservability are damaged and in that a load for waste solution treatment increases, although some effects are found.

Attempts to overcome the blix discoloration of cyan dye using a polymer latex has been made. Specifically, the use of a polymer latex having an alkoxyalkyl group in its side chain in order to prevent the conversion of cyan dye to its leuco-body is described, for example, in JP-A-64-52136 and JP-A-2-289840. However, the effect of such a polymer latex is still insufficient, and there is a problem to be solved in its property in case of conducting the color development processing in a short time. Further, the polymer latex is poor in its dispersion stability. Neither the specific polymer latex having such a high acid content as in the present invention nor its superior effect is described in these patents.

Therefore, a technique which has a large effect on preventing the blix discoloration of cyan dye and which is not accompanied with the above described problems is desired.

On the other hand, a polymer latex copolymerized with a monomer having a -COOH group is known in the field of photographic light-sensitive material. For example, in U.S. Pat. No. 3,287,289, a copolymer latex such as one of n-butyl acrylate and an acrylic acid or methacrylic acid is described. However, there is no disclosure that among the hitherto known polymer latexes, those having a high acid content are particularly effective to prevent the blix discoloration of cyan dye formed from a cyan coupler.

SUMMARY OF THE INVENTION

The present invention has been made with the above-described background, and an object of the present invention is to provide a silver halide color photographic light-sensitive material which is subjected to color development processing in a short time, which has an excellent color forming property, which is prevented from the blix discoloration of dye image formed and which provides a color photograph having an excellent image quality in that degradation of color balance of the image does not occur after processing.

Other objects of the present invention will become apparent from the following description and examples.

As a result of intensive investigations, it has been found that the above-described objects of the present invention are accomplished with a silver halide color photographic light-sensitive material comprising a support having provided thereon at least one silver halide emulsion layer, wherein the silver halide emulsion layer contains at least one cyan dye forming coupler and at least one polymer latex represented by the following formula (I):

$$-(A)_x-(B)_y- \quad (I)$$

wherein A represents a repeating unit derived from at least one ethylenically unsaturated monomer having at least one —COOM group (wherein M represents a hydrogen atom or a cation) in its molecule; B represents a repeating unit derived from at least one ethylenically unsaturated monomer which does not have the —COOM group; and x and y represent weight percentages of A and B, respectively, x represents a number of from 25 to 85, y represents a number of from 75 to 15, and x+y=100.

DETAILED DESCRIPTION OF THE INVENTION

Preferred embodiments of the silver halide color photographic light-sensitive material according to the present invention include the followings:

(1) the silver halide color photographic light-sensitive material as set forth above, wherein the silver halide emulsion layer contains silver halide grains having a silver chloride content of 90 mol % or more;

(2) the silver halide color photographic light-sensitive material as set forth above or in item (1), wherein the polymer latex is represented by the following formula (II):

(II)

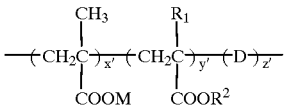

wherein $R^1$ represents a hydrogen atom or a methyl group; $R^2$ represents an alkyl group having from 1 to 8 carbon atoms or a cycloalkyl group; D represents a repeating unit derived from other ethylenically unsaturated monomer, M represents a hydrogen atom or a cation; and x', y' and z' each represents a weight percentage of each repeating unit, x' represents a number of from 25 to 60, y' represents a number of from 75 to 40, z' represents a number of from 0 to 30, and x'+y'+z'=100; and (3) the silver halide color photographic light-sensitive material as set forth above or in item (2), wherein a neutralization ratio of carboxylic acid group in the polymer latex represented by the formula (I) or (II) is from 0 to 20%.

The polymer latex represented by the formula (I) will be described in greater detail below.

In the formula (I), suitable examples of the monomer which provides the repeating unit represented by A include acrylic acid, methacrylic acid, itaconic acid, crotonic acid, maleic acid,

A-1

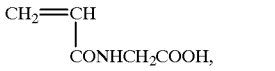

A-2

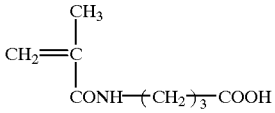

A-3

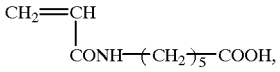

A-4

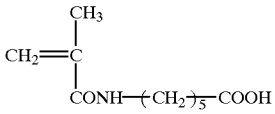

A-5

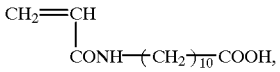

A-6

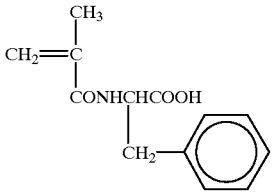

A-7

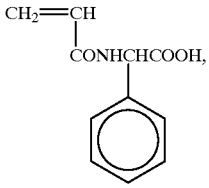

A-8

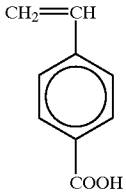

A-9

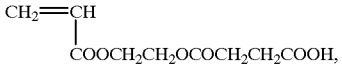

A-10

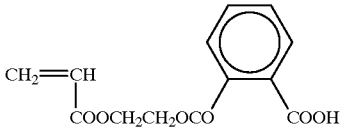

A-11

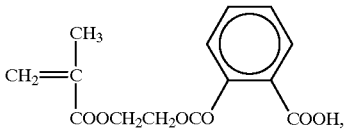

-continued

A-12

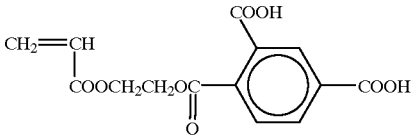

A-13

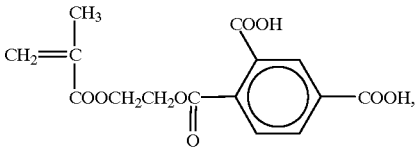

A-14

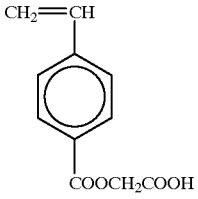

A-15

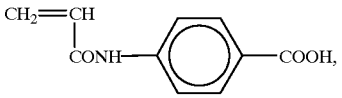

A-16

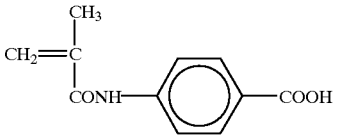

A-17

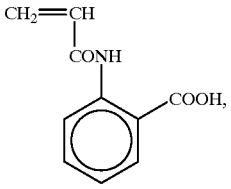

A-18

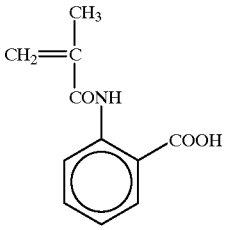

A-19

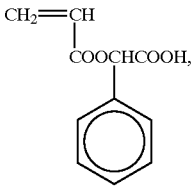

-continued

A-20

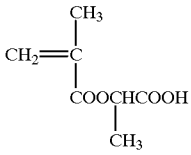

and

A-21

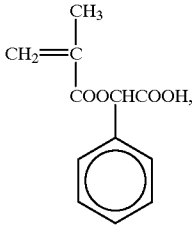

The carboxylic acid group in the monomer may form a salt as —COOM to the extent that the resulting polymer latex is insoluble.

The cation represented by M includes a metal ion (for example, sodium or potassium), or an ammonium ion (for example, ammonium, dimethylammonium or triethylammonium).

The ethylenically unsaturated monomer for the repeating unit represented by B include an acrylic acid ester, a methacrylic acid ester, a vinyl ester, an acrylamide, a methacrylamide, an olefin, a styrene, a vinyl ether and other monomers.

Specific examples of acrylic acid esters include methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tert-octyl acrylate, n-decyl acrylate, n-dodecyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, etc.

Specific examples of methacrylic acid esters include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, etc.

Specific examples of vinyl esters include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Specific examples of acrylamides include acrylamide, methylacrylamide, ethylacrylamide, propylacrylamide, butylacrylamide, tert-butylacrylamide, cyclohexylacrylamide, benzylacrylamide, hydroxymethylacrylamide, phenylacrylamide, dimethylacrylamide, diethylacrylamide, β-cyanoethylacrylamide, N-(2-acetoacetoxyethyl) acrylamide, diacetonacrylamide, etc.

Specific examples of methacrylamide include methacrylamide, methylmethacrylamide, ethylmethacrylamide, propylmethacrylamide, butylmethacrylamide, tert-butyl-methacrylamide, cyclohexylmethacrylamide, benzylmethacryl- amide, hydroxymethylmethacrylamide, phenylmethacrylamide, dimethylmethacrylamide, diethylmethacrylamide, β-cyanoethylmethacrylamide, N-(2-acetoacetoxyethyl)-methacrylamide, etc.

Specific examples of olefins include dicyclopentadiene, ethylene, propylene, 1-butene, 1-pentene, vinyl chloride, vinylidene chloride, isoprene, chloroprene, butadiene, 2,3-dimethylbutadiene, etc.

Specific examples of styrenes include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, vinyl benzoic acid methyl ester, etc.

Specific examples of vinyl ethers include methyl vinyl ether, butyl vinyl ether, hexyl vinyl ether, methoxyethyl vinyl ether, dimethylaminoethyl vinyl ether, etc.

Specific examples of other monomers include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, methacrylonitrile, methylene malononitrile, etc.

Further, an ethylenically unsaturated monomer having an anionic group other than the -COOM group (for example, a sulfonic acid group, or a sulfuric acid ester group) is employed as the monomer for the repeating unit represented by B. Specific Examples of such ethylenically unsaturated monomers include styrene sulfonic acid; vinylbenzylsulfonic acid; vinylsulfonic acid; an acryloyloxyalkylsulfonic acid (for example, acryloyloxymethylsulfonic acid, acryloyloxyethylsulfonic acid, or acryloyloxypropylsulfonic acid); a methacryloyloxyalkylsulfonic acid (for example, methacryloyloxymethylsulfonic acid, mechacryloyloxyethylsulfonic acid, or methacryloyloxypropylsulfonic acid); an acrylamidoalkylsulfonic acid (for example, 2-acrylamido-2-methylethanesulfonic acid, 2-acrylamido-2-methylpropanesulfonic acid, or 2-acrylamido-2-methylbutanesulfonic acid); a methacrylamidoalkylsulfonic acid (for example, 2-methacrylamido-2-methylethanesulfonic acid, 2-methacrylamido-2-methylpropanesulfonic acid, or 2-methacrylamido-2-methylbutanesulfonic acid); or a salt thereof.

The ethylenically unsaturated monomer for the repeating unit represented by B is preferably a monomer which forms a homopolymer that is insoluble in water. When a monomer which forms a water-soluble homopolymer is employed for the repeating unit represented by B, an amount of the monomer is preferably in a range of from 0 to 20% by weight in the resulting polymer.

Preferred ethylenically unsaturated monomers for the repeating unit represented by B include acrylic acid esters, methacrylic acid esters and vinyl esters. Acrylic acid esters and methacrylic acid esters are particularly preferred.

Two or more kinds of monomers can be employed for the repeating unit represented by A and/or for the repeating unit represented by B.

Although a preferred ratio of x to y may be varied depending on the ethylenically unsaturated monomers constituting the repeating units represented by A and B, x is preferably from 25 to 70% by weight, more preferably from 25 to 60% by weight, and y is preferably from 75 to 30% by weight, more preferably from 75 to 40% by weight, where x+y=100.

According to one preferred embodiment of the present invention, the polymer latex includes that represented by the formula (II) described above.

In the formula (II), $R^2$ is an alkyl group having preferably from 1 to 7 carbon atoms, more preferably from 2 to 6 carbon atoms, which is unsubstituted or substituted with a halogen atom or a phenyl group, or a cycloalkyl group having preferably from 3 to 6 carbon atoms, more preferably 6 carbon atoms, which is unsubstituted or substituted with a halogen atom. Preferred examples of $R^2$ include methyl, ethyl, n-propyl, isopropyl, n-butyl, sec-butyl, tert-butyl, isobutyl, n-amyl, n-hexyl, cyclopropyl, cyclopentyl, cyclohexyl, benzyl, 3-chloropropyl, and 3-bromopropyl. Among them, an unsubstituted straight chain or branched chain alkyl group and a cycloalkyl group are particularly preferred.

D represents a repeating unit derived form other ethylenically unsaturated monomer and specifically a repeating unit derived from an ethylenically unsaturated monomer selected from a group of monomers which are the monomers for the repeating unit represented by B with the exception of the monomers represented by the formula of $CH_2{=}C(R^1)COOR^2$.

x', y' and z' each represents a preferable weight percentage of each repeating unit, x' represents a number of from 25 to 60, y' represents a number of from 75 to 40, z' represents a number of from 0 to 30, and x'+y'+z'=100.

The —COOH group in the polymer latex according to the present invention may be neutralized to the extent that the resulting polymer latex is insoluble in water. In view of the ability of preventing the blix discoloration, however, it is preferred that the neutralization ratio of the —COOH group is small. The neutralization ratio of the —COOH group is preferably from 0 to 20% and more preferably from 0 to 10%. The neutralization ratio of the carboxylic acid group is defined as a ratio of COOM/COOH+COOM (wherein M represents a cation) in the repeating unit represented by A in the formula (I) or the repeating unit of $—CH_2—C(CH_3)COOM—$ in the formula (II).

The term "insoluble in water" used with respect to the polymer latex above means that solubility of the polymer latex is not more than 1 g per 100 ml of water at 25° C.

Specific examples of the compound represented by the formula (I) which can be used in the present invention are set forth below together with the copolymerization ratio by weight and the ratio of —COOH in —COOM, but the present invention should not be construed as being limited thereto.

P-1 Methacrylic acid/n-butyl acrylate copolymer (30/70), M=H/Na (90/10)

P-2 Methacrylic acid/n-butyl acrylate copolymer (40/60), M=H/Na (90/10)

P-3 Methacrylic acid/n-butyl acrylate copolymer (50/50), M=H/Na (90/10)

P-4 Methacrylic acid/n-butyl acrylate copolymer (55/45), M=H (100)

P-5 Methacrylic acid/methyl acrylate copolymer (25/75), M=H/K (90/10)

P-6 Methacrylic acid/ethyl acrylate copolymer (30/70), M=H (100)

P-7 Methacrylic acid/ethyl acrylate copolymer (35/65), M=H (100)

P-8 Methacrylic acid/n-hexyl acrylate copolymer (45/55), M=H (100)

P-9 Methacrylic acid/cyclohexyl acrylate copolymer (40/60), M=H (100)

P-10 Methacrylic acid/cyclohexyl methacrylate copolymer (40/60), M=H (100)

P-11 Methacrylic acid/methyl methacrylate copolymer (30/70), M=H/Na (80/20)

P-12 Methacrylic acid/ethyl methacrylate copolymer (40/60), M=H (100)

P-13 Methacrylic acid/n-propyl methacrylate copolymer (40/60), M=H (100)

P-14 Methacrylic acid/sec-butyl methacrylate copolymer (40/60), M=H (100)

P-15 Methacrylic acid/tert-butyl methacrylate copolymer (50/50), M=H/K (90/10)

P-16 Acrylic acid/ethyl acrylate copolymer (25/75), M=H/Na (90/10)

P-17 Acrylic acid/n-butyl acrylate copolymer (35/65), M=H (100)

P-18 Acrylic acid/methyl methacrylate copolymer (30/70), M=H/Na (80/20)

P-19 Acrylic acid/ethyl methacrylate copolymer (30/70), M=H/Na (95/5)

P-20 Methacrylic acid/n-butyl acrylate/methyl acrylate copolymer (40/40/20), M=H (100)

P-21 Acrylic acid/cyclohexyl methacrylate/2-hydroxyethyl methacrylate copolymer (40/50/10), M=H (100)

P-36 A-5/acrylic acid/methyl methacrylate copolymer (50/20/30), M=H/Na (90/10)

The polymer latex used in the present invention can be prepared by an emulsion polymerization method ordinarily well known in the art. The emulsion polymerization is conducted by emulsifying monomers in water or a mixed solvent of water and a water-miscible organic solvent (for example, methanol, ethanol or acetone) preferably using at least one emulsifying agent and adding a radial polymerization initiator at a temperature ranging usually from 30° C. to about 100° C., preferably from 40° C. to about 90° C. The amount of water-miscible organic solvent to be used is from 0 to 100% by volume, preferably from 0 to 50% by volume based on the amount of water.

The polymerization reaction is ordinarily performed using the radical polymerization initiator in an amount of from 0.05 to 5% by weight based on the total amount of the monomers to be polymerized and, if desired, the emulsifying agent in an amount of from 0.1 to 10% by weight based on the total amount of the monomers. As the polymerization initiator, an azobis compound, a peroxide, a hydroperoxide, or a redox catalyst is employed. Specific examples of the polymerization initiator include potassium persulfate, ammonium persulfate, tert-butyl peroctoate, benzoyl peroxide, isopropyl percarbonate, 2,4-dichlorobenzene peroxide, methyl ethyl ketone peroxide, cumene hydroperoxide, dicumyl peroxide, 2,2'-azobisisobutyrate, 2,2'-azobis(2-amidinopropane) hydrochloride, and a combination of potassium persulfate and sodium hydrogensulfite.

As the emulsifying agent, an anionic, cationic, amphoteric or nonionic surface active agent, or a water-soluble polymer is employed. Specific examples of the emulsifying agent include sodium laurate, sodium dodecylsulfate, sodium 1-octoxycarbonylmethyl-1-octoxycarbonylmethanesulfonate, sodium laurylnaphthalenesulfonate, sodium laurylbenzenesulfonate, sodium laurylphosphate, cetyl trimethyl ammonium chloride, dodecyl trimethylene ammonium chloride, N-2-ethylhexyl pyridinium chloride, polyoxyethylene nonyl phenyl ether, polyoxyethylene sorbitan laurate, sodium dodecyl diphenyl ether disulfonate, sodium 2-tetradecene-1-sulfonate, 3-hydroxytetradecane-1-sulfonate, gelatin, polyvinyl alcohol, and the emulsifying agents and water-soluble polymers described in JP-B-53-6190 (the term "JP-B" as used herein means an "examined Japanese patent publication"). Among others, anionic or nonionic surface active agents and water-soluble polymers are particularly preferred.

A particle diameter of the polymer latex is not particularly restricted, and usually not more than 1.0 $\mu$m, preferably not more than 0.7 $\mu$m, particularly preferably not more than 0.5 $\mu$m in view of the stability thereof. On the other hand, the lower limit is preferably 0.00001 $\mu$m or more.

The polymer latex has the excellent effects irrespective of its molecular weight. Taking diffusion to other layers at the time of coating or at the time of processing and viscosity of a coating solution into consideration, however, the weight average molecular weight thereof is preferably from $5\times10^3$ to $1\times10^7$, more preferably from $1\times10^4$ to $5\times10^6$ and particularly preferably from $2\times10^4$ to $3\times10^6$.

Since the polymer latex obtained is a dispersion of fine polymer particles, it can be directly mixed with a hydrophilic colloid and coated in the form of a dispersion in an aqueous medium.

Gelatin is preferably employed as the hydrophilic colloid which is mixed with the polymer latex of the present invention. Examples of gelatin include lime processed gelatin, acid processed gelatin and enzyme-processed gelatin. The hydrolyzates and enzymatic hydrolyzates of gelatin can also be used.

In addition to gelatin, other hydrophilic colloid can also be used. Examples of other hydrophilic colloid include proteins such as albumin and casein; cellulose derivatives such as hydroxyethyl cellulose, carboxymethyl cellulose and cellulose sulfate; sugar derivatives such as sodium alginate, dextran and starch derivatives; and synthetic hydrophilic high-molecular materials such as homopolymers, for example, polyvinyl alcohol, polyvinyl alcohol partial acetal, poly-N-vinylpyrrolidone, polyacrylamide, polyvinyl imidazole and polyvinyl pyrazole and copolymers thereof.

The pH of coating solution prepared by mixing the polymer latex with the hydrophilic colloid is preferably from 5.0 to 8.0, more preferably from 5.5 to 7.0, and still more preferably from 5.8 to 6.5.

The ratio of the polymer latex to the hydrophilic colloid (polymer-containing ratio) is not particularly restricted. However, the value of polymer ratio as defined below is preferably from 0.01 to 0.3.0, more preferably from 0.02 to 0.20, and still more preferably from 0.02 to 0.15.

$$\text{Polymer ratio} = \frac{\text{Coating amount of the copolymer of the present invention}}{\text{Coating amount of the hydrophilic colloid}}$$

Preferred cyan couplers which can be used in the present invention include naphthol type cyan couplers, phenol type cyan couplers, diphenylimidazole type cyan couplers disclosed in JP-A-2-33144, 3-hydroxypyridine type cyan couplers disclosed in EP-A-333185, cyclic active methylene type cyan couplers disclosed in JP-A-64-32260, pyrrolopyrazole type cyan couplers disclosed in EP-A-456226, pyrroloimidazole type cyan couplers disclosed in European Patent 484909, and pyrrolotriazole type cyan couplers disclosed in European Patent 488248 and EP-A-491197.

Among others, naphthol type cyan couplers, phenol type cyan couplers and pyrrolotriazole type cyan couplers are particularly preferred. Of the pyrrolotriazole type cyan couplers, those described in JP-A-8-110623 are especially preferred.

In the silver halide color photographic light-sensitive material according to the present invention, other various conventionally known photographic elements and additives can be employed.

For instance, a transmissive type support or reflective type support is used as the photographic support. Among the transmissive type support, a transparent film such as a cellulose nitrate film or a polyethylene terephthalate film, and a polyester film composed of 2,6-naphthalenedicarboxylic acid (NDCA) and ethylene glycol (EG) or composed of NDCA, terephthalic acid and EG having a provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers in preferred.

It is preferred that the water-resistant resin layer contains a fluorescent whitening agent. The fluorescent whitening agent may also be dispersed in a hydrophilic colloid layer of the photographic light-sensitive material. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and a reflective type support each having provided thereon a hydrophilic colloid layer containing a white pigment may be employed.

Moreover, a support having a mirror plate reflective metal surface or a secondary diffusion reflective metal surface may be used as the reflective type support.

A silver chloride or silver chlorobromide emulsion having a silver chloride content of 90 mol % or more is preferably used as the silver halide emulsion in the color photographic eight-sensitive material of the present invention in view of rapid processing suitability. Further, a silver halide emulsion more preferably has a silver chloride content of 95 mol % or more, particularly preferably 98 mol % or more. Of these silver halide emulsions, those having a silver bromide localized phase on the surface of silver chloride grain is particularly preferred, since high sensitivity as well as stabilization of photographic characteristics are achieved.

With respect to the reflective type support, silver halide emulsion, heterogenous metal ion doped in silver halide grain, stabilizer and antifoggant for silver halide emulsion, chemical sensitization (chemical sensitizer), spectral sensitization (spectral sensitizer), cyan coupler, magenta coupler, yellow coupler, emulsified dispersion method of coupler, color image stabilizer (anti-staining agent), color fading preventing agent, dye (colored layer), gelation, layer construction of photographic material and pH of coated layer, those described in the patents shown in Table 1 are preferably used in the present invention.

TABLE 1

| Photographic Element | JP-A-7-104448 | JP-A-7-77775 | JP-A-7-301895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Silver Halide Emulsion | Col. 72, line 29 to Col. 74, line 18 | Col. 44, line 36 to Col. 46, line 29 | Col. 77, line 48 to Col. 80, line 28 |
| Heterogeneous Metal Ion | Col. 74, lines 19 to 44 | Col. 46, line 30 to Col. 47, line 5 | Col. 80, line 29 to Col. 81, line 6 |
| Stabilizer and Antifoggant | Col. 75, lines 9 to 18 | Col. 47, lines 20 to 29 | Col. 18, line 11 to Col. 31, line 37 (particularly, mercapto heterocyclic compound) |
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, lines 50 to 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |
| Magenta Coupler | Col. 89, lines 4 to 18 | Col. 63, line 3 to Col. 64, line 11 | Col. 31, line 34 to Col. 77, line 44 and Col. 88, lines 32 to 46 |
| Emulsified Dispersion Method of Coupler | Col. 71, line 3 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, line 38 to Col. 32, line 33 |
| pH of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91 right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the visible spectra are employed depending on the demand. For instance, a red light emitting material, a green light emitting material and a blue light emitting material are used individually or in a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adopted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-6}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patent set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed.

The wet type developing process includes a developing method using a conventional developing solution containing an alkaline agent and a developing agent, and an activator method in which a photographic light-sensitive material containing a developing agent is developed with an activator solution such as an alkaline solution containing no developing agent. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in Japanese Patent Application Nos. 7-63572 (corresponding to JP-A-8-234388 and EP 0730198A2), 7-334190, 7-334192, 7-334197 and 7-344396.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in Japanese Patent Application Nos. 7-63587 and 7-334202 is preferably employed.

According to the activator method, the photographic material is ordinarily subjected to a desilvering treatment after the treatment with the activator solution. However, in the image amplification process using the photographic material having a reduced coating amount of silver, the desilvering treatment is omitted and a simple treatment such as washing with water or stabilizing treatment is conducted. Further, in a system wherein an image information is read from a photographic material by a scanner, the processing method omitting the desilvering treatment can be adopted, even when a photographic light-sensitive material having a large coating amount of silver such as a photographic light-sensitive material for photographing is processed.

Processing elements and processing methods for the activator treatment, desilvering (bleaching/fixing), water washing and stabilizing used in the present invention include those known in the art. Preferably, those described in *Research Disclosure*, September 1994, Item 36544, pages 536 to 541 and Japanese Patent Application No.7-63572 (JP-A-8-23488) are employed.

The present invention can be applied to various color photographic light-sensitive materials. Representative examples include color negative film for common use or movie, color reversal films for slide or television, color paper, color positive films and color reversal paper. The present invention is particularly effective to apply to the photographic light-sensitive material having a high silver chloride content as described above. It is particularly preferred that the present invention is applied to color paper.

The sliver halide color photographic light-sensitive material according to the present invention is excellent in rapid processing suitability and provides a color photograph having a high color density and an excellent image quality in which degradation of color balance does not occur with the lapse of time after processing since the blix discoloration of cyan image in that the cyan dye formed by color development turns into its leuco-body in a bleaching or blixing solution is substantially prevented.

The present invention will be explained in greater detail with reference to the following examples, but the present invention should not be construed as being limited thereto.

EXAMPLE 1

A surface of a paper support laminated with polyethylene on both sides was subjected to a corona discharge treatment. On the surface subjected to the corona discharge treatment was provided a gelatin undercoat layer containing sodium dodecylbenzenesulfonate, and various photographic constituent layers described below were coated thereon to prepare a silver halide multilayer color photographic light-sensitive material designated Sample 101.

Preparation of Coating Solution for First Layer 122.0 g of Yellow Coupler (EXY), 15.4 g of Color Image Stabilizer (Cpd-1), 7.5 g of Color Image Stabilizer (Cpd-2) and 16.7 g of Color Image Stabilizer (Cpd-3) were dissolved in a mixture of 44 g of Solvent (Solv-1) and 180 ml of ethyl acetate, and the solution was emulsified and dispersed into 1,000 g of a 10% aqueous gelatin solution containing 86 ml of a 10% aqueous solution of sodium dodecylbenzenesulfonate to prepare Emulsified Dispersion A.

On the other hand, Silver Colorobromide Emulsion A was prepared (a cubic form, a mixture in a ratio of 3/7 (silver mol ratio) of a large grain size emulsion having an average grain size of 0.88 $\mu$m, and a small grain size emulsion having an average grain size of 0.70 $\mu$m; variation coefficients of the grain size distribution being 0.08 and 0.10, respectively, both of them containing 0.3 mol % of silver bromide localized at a part of the surface of each grain having silver chloride as substrate). The blue-sensitive Sensitizing Dyes A, B and C shown below were added each in an amount of $8.0\times10^{-5}$ mol per mol of silver to the large grain size emulsion, and each $1.0\times10^{-4}$ mol per mol of silver to the small grain size emulsion. Further, chemical sensitization was conducted optimally by the addition of a sulfur sensitizer and a gold sensitizer.

Emulsified Dispersion A was mixed with the blue-sensitive Silver Chlorobromide Emulsion A and the mixture was dissolved to prepare a coating solution for the first layer having the composition described below. The coating amount of emulsion is indicated in terms of silver.

The coating solutions for the second to seventh layers were prepared in the same manner as the coating solution for the first layer. 1-Oxy-3,5-dichloro-s-triazine sodium salt was used as a gelatin hardening agent in each layer.

Further, Cpd-12, Cpd-13, Cpd-14 and Cpd-15 shown below were added to each layer so that the total coating amount became 15.0 mg/m$^2$, 60.0 mg/m$^2$, 5.0 mg/m$^2$ and 10.0 mg/m$^2$, respectively.

The following spectral sensitizing dyes were employed in the silver chlorobromide emulsions in the light-sensitive emulsion layers, respectively.

Blue-Sensitive Emulsion Layer:

Sensitizing Dye A

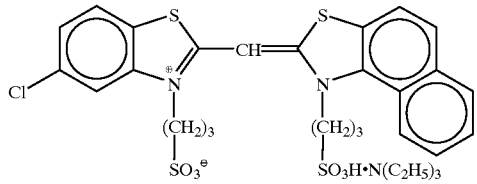

Sensitizing Dye B

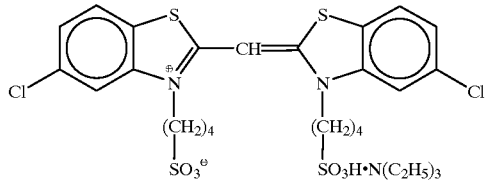

Sensitizing Dye C

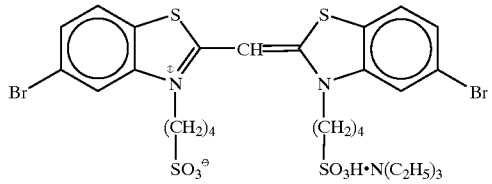

Green-Sensitive Emulsion Layer:

Sensitizing Dye D

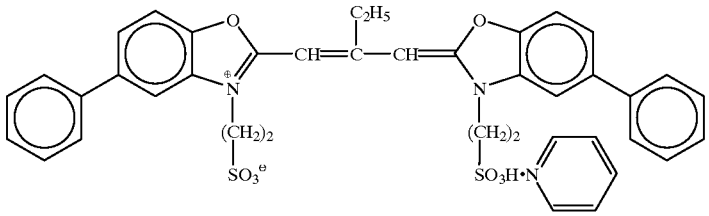

(in an amount of $3.0\times10^{-4}$ mol per mol of the silver halide to the large grain size emulsion, and in an amount of $3.6\times10^{-4}$ mol per mol of the silver halide to the small grain size emulsion)

Sensitizing Dye E

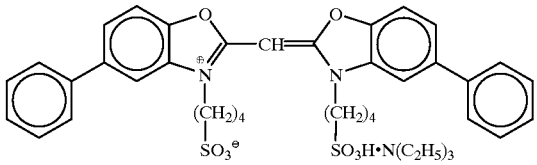

(in an amount of $4.0\times10^{-5}$ mol per mol of the silver halide to the large grain size emulsion, and in an amount of $7.0\times10^{-5}$ mol per mol of the silver halide to the small grain size emulsion)

Sensitizing Dye F

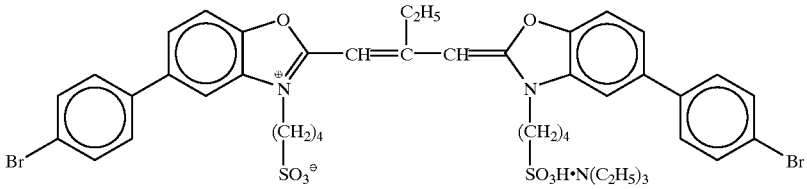

(in an amount of $2.0\times10^{-4}$ mol per mol of the silver halide to the large grain size emulsion, and in an amount of $2.8\times10^{-4}$ mol per mol of the silver halide to the small grain size emulsion)

Red-Sensitive Emulsion Layer

Sensitizing Dye G

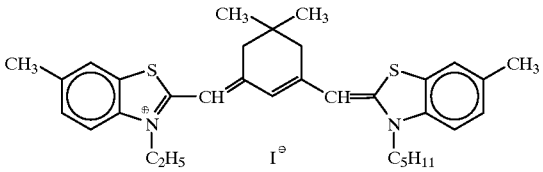

Sensitizing Dye H

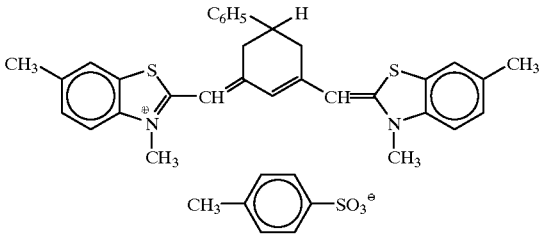

(each in an amount of $5.0\times10^{-5}$ mol per mol of the silver halide to the large grain size emulsion, and each in an amount of $8.0\times10^{-5}$ mol per mol of the silver halide to the small grain size emulsion)

Also, the following compound was added to the red-sensitive emulsion layer in an amount of $2.6\times10^{-3}$ mol per mol of the silver halide.

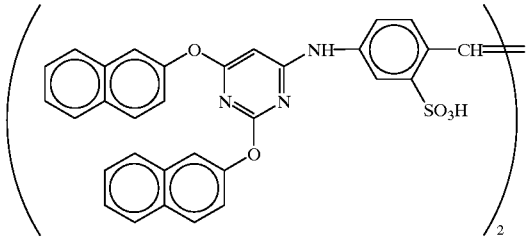

Further, 1-(5-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide.

The mercaptotetrazole compound was also added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetra-azaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes were added to the sixth layer as irradiation preventing water-soluble dyes.

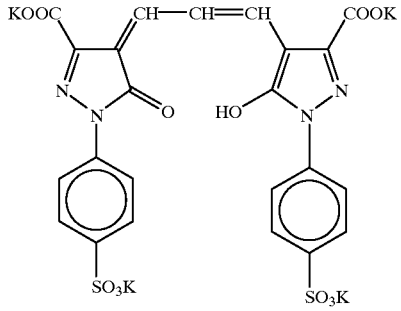

(10 mg/m$^2$)

and

-continued

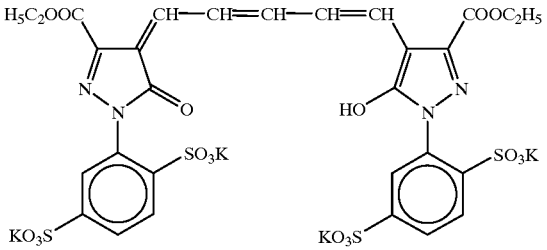

(40 mg/m$^2$)

Layer Construction

The composition of each layer is described below. The numeral represents the coating amount (g/m$^2$). The numeral for silver halide emulsion represents the coating amount in terms of silver.

Support

Polyethylene-laminated paper containing a white pigment (titanium dioxide) in an amount of 15 wt % and a bluish dye (ultramarine) in the polyethylene laminated layer on the side of the first layer.

| | |
|---|---|
| First Layer (blue-sensitive emulsion layer) | |
| Silver Chlorobromide Emulsion A | 0.25 |
| Gelatin | 1.38 |
| Yellow Coupler (ExY) | 0.60 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.22 |
| Second Layer (color mixing preventing layer) | |
| Gelatin | 1.01 |
| Color Mixing Preventing Agent (Cpd-4) | 0.13 |
| Solvent (Solv-1) | 0.07 |
| Solvent (Solv-2) | 0.20 |
| Solvent (Solv-3) | 0.15 |
| Solvent (Solv-7) | 0.12 |
| Color Image Stabilizer (Cpd-7) | 0.10 |
| Third Layer (green-sensitive emulsion layer) | |
| Silver Chlorobromide Emulsion (a cubic form, a mixture in a ratio of ⅓ (silver mol ratio of a large grain size emulsion having an average grain size of 0.55 μm and a small grain size emulsion having an average grain size of 0.39 μm; variation coefficients of the grain size distribution were 0.10 and 0.08, respectively, both of them containing 0.8 mol % of silver bromide localized at a part of the surface of each grain having silver chloride as substrate) | 0.13 |
| Gelatin | 1.45 |
| Magenta Coupler (ExM) | 0.13 |
| Ultraviolet Absorber (UV-A) | 0.12 |
| Color Image Stabilizer (Cpd-2) | 0.01 |
| Color Image Stabilizer (Cpd-5) | 0.02 |
| Color Image Stabilizer (Cpd-6) | 0.01 |
| Color Image Stabilizer (Cpd-7) | 0.08 |
| Color Image Stabilizer (Cpd-8) | 0.03 |
| Color Image Stabilizer (Cpd-9) | 0.01 |
| Solvent (Solv-4) | 0.22 |
| Solvent (Solv-5) | 0.11 |
| Solvent (Solv-8) | 0.15 |
| Fourth Layer (color mixing preventing layer) | |
| Gelatin | 0.73 |
| Color Mixing Preventing Agent (Cpd-4) | 0.10 |
| Solvent (Solv-1) | 0.05 |
| Solvent (Solv-2) | 0.15 |
| Solvent (Solv-3) | 0.12 |

-continued

| | |
|---|---|
| Solvent (Solv-7) | 0.09 |

| | |
|---|---|
| P-22 | Methacrylic acid/methyl methacrylate/styrene copolymer (40/30/30), M = H (100) |
| P-23 | Methacrylic acid/acrylic acid/benzyl methacrylate copolymer (20/20/60), M = H (100) |
| P-24 | Methacrylic acid/n-butyl acrylate/vinyl acetate copolymer (40/40/20), M = H (100) |
| P-25 | Methacrylic acid/sodium 2-acrylamido-2-methylpropane-sulfonate/ethyl methacrylate copolymer (30/5/65), M = H/Na (90/10) |
| P-26 | Methacrylic acid/itaconic acid/n-butyl acrylate copolymer (30/10/60), M = H/K (95/5) |
| P-27 | A-1/ethyl acrylate copolymer (60/40), M = H/Na (90/10) |
| P-28 | A-3/methyl acrylate copolymer (60/40), M = H/Na (80/20) |
| P-29 | A-3/acrylamide/tert-butyl acrylate copolymer (40/10/50), M = H (100) |
| P-30 | A-8/styrene/methyl methacrylate copolymer (60/15/25), M = H (100) |
| P-31 | A-10/2-hydroxyethyl acrylate/n-butyl acrylate copolymer (60/10/30), M = H (100) |
| P-32 | A-17/n-butyl methacrylate copolymer (80/20), M = H (100) |
| P-33 | A-17/sodium 2-acrylamido-2-methylpropanesulfonate/n-butyl methacrylate copolymer (65/5/30), M = H/Na (90/10) |
| P-34 | A-1/methacrylic acid/n-butyl acrylate copolymer (20/25/55), M = H (100) |
| P-35 | A-3/methacrylic acid/ethyl acrylate copolymer (30/20/50), M = H (100) |

| | |
|---|---|
| Color Image Stabilizer (Cpd-7) | 0.07 |
| Fifth Layer (red-sensitive emulsion layer) | |
| Silver Chlorobromide Emulsion (a cubic form, a mixture in a ratio of ¼ (silver mol ratio) of a large grain size emulsion having an average grain size of 0.50 μm and a small grain size emulsion having an average grain size of 0.41 μm; variation coefficients of the grain size distribution were 0.09 and 0.11, respectively, both of them containing 0.8 mol % of silver bromide localized at a part of the surface of each grain having silver chloride as substrate) | 0.19 |
| Gelatin | 0.74 |
| Cyan Coupler (ExC) | 0.24 |
| Ultraviolet Absorber (UV-B) | 0.21 |
| Color Image Stabilizer (Cpd-1) | 0.20 |
| Color Image Stabilizer (Cpd-6) | 0.01 |
| Color Image Stabilizer (Cpd-8) | 0.01 |
| Color Image Stabilizer (Cpd-9) | 0.01 |
| Color Image Stabilizer (Cpd-10) | 0.01 |
| Solvent (Solv-1) | 0.01 |
| Solvent (Solv-6) | 0.20 |
| Sixth Layer (ultraviolet absorbing layer) | |
| Gelatin | 0.73 |
| Ultraviolet Absorber (UV-C) | 0.34 |
| Color Image Stabilizer (Cpd-7) | 0.05 |
| Solvent (Solv-9) | 0.40 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surface Active Agent (Cpd-11) | 0.01 |

The compounds used for preparing the composition of each layer described above are shown below.

(ExY) Yellow Coupler
1/1/1 mixture by mol ration of
(ExY-1)
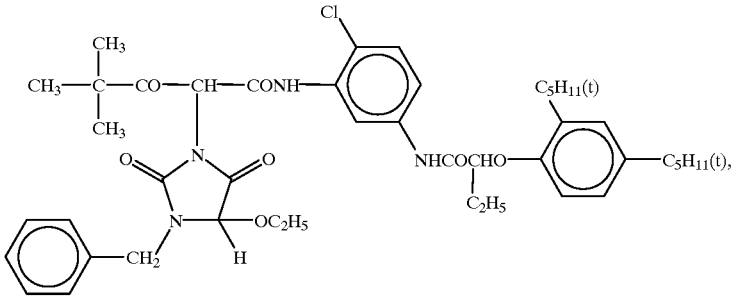
(ExY-2)
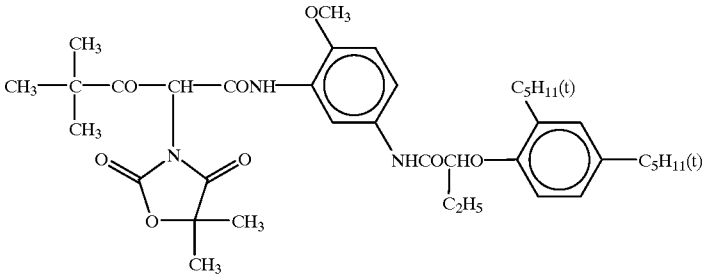
and
(ExY-3)
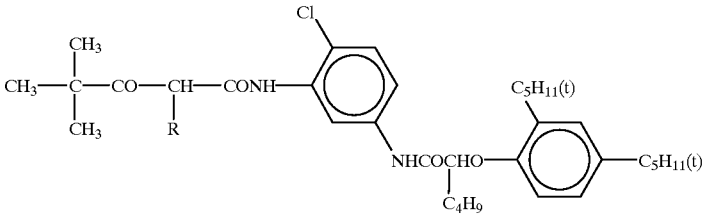
-continued
(ExM) magenta Coupler
1/5 mixture by mol ratio of
(ExM-1)
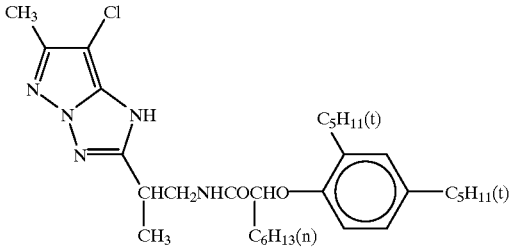
and
(ExM-2)
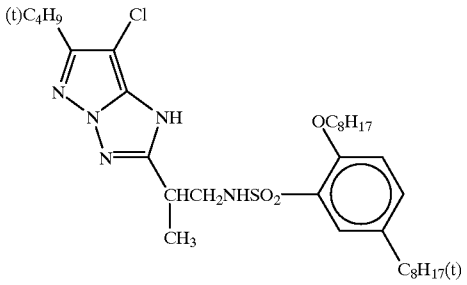

(ExC) Cyan Coupler

1/1 mixture by mol ratio of (ExC-1)

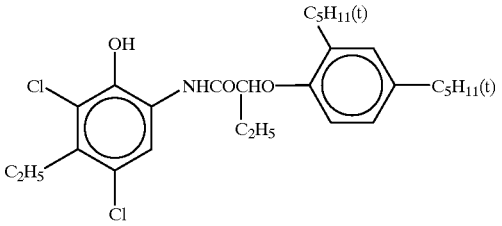

and (ExC-2)

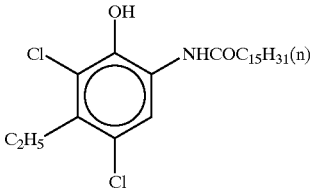

(Cpd-1) Color Image Stabilizer

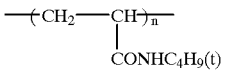

number average molecular weight: 60,000

(Cpd-2) Color Image Stabilizer

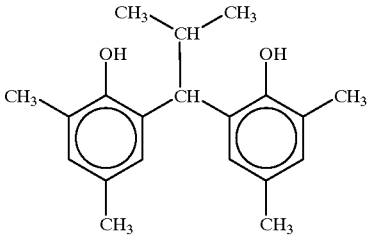

(Cpd-3) Color Image Stabilizer

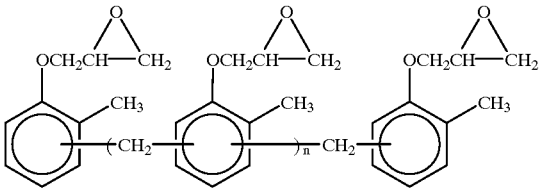

n = 7 to 8 (average value)

(Cpd-4) Color Image Stabilizer

1/1/1 mixture by weight ratio of

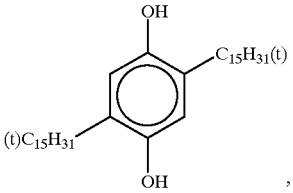

,

-continued

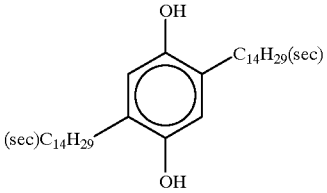

and

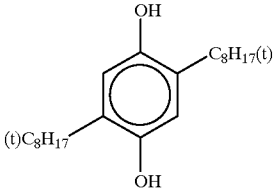

(Cpd-5) Color Image Stabilizer

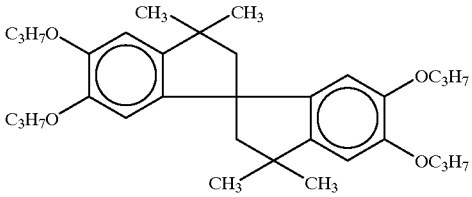

(Cpd-6) Color Image Stabilizer

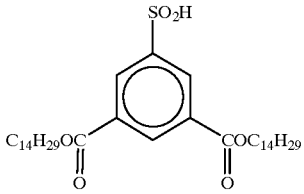

(Cpd-7) Color Image Stabilizer

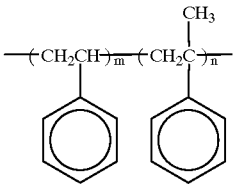

number average molecular weight: 600
m/n = 10/90

(Cpd-8) Color Image Stabilizer

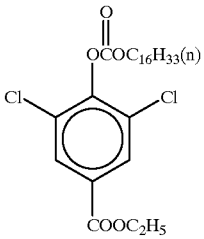

(Cpd-9) Color Image Stabilizer

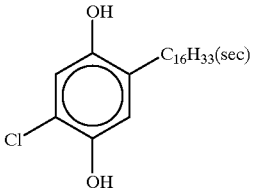

-continued (Cpd-10) Color Image Stabilizer

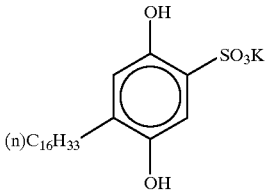

(Cpd-11) Surface Active Agent

7/3 mixture by weight ratio of

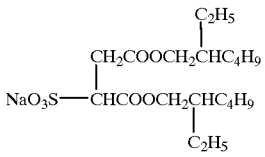

and

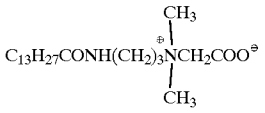

(Cpd-12) Preservative

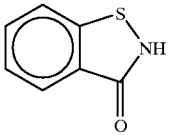

(Cpd-13) Preservative

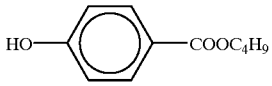

(Cpd-14) Preservative

1/1/1 mixture by weight ratio of a, b, c and d

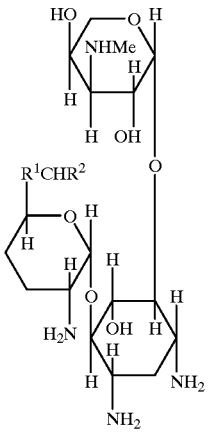

| | $R^1$ | $R^2$ |
|---|---|---|
| a | —Me | —NHMe |
| b | —Me | —$NH_2$ |
| c | —H | —$NH_2$ |
| d | —H | —NHMe |

-continued (Cpd-15) Preservative

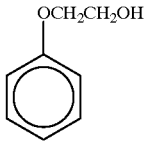

(Solv-1) Solvent

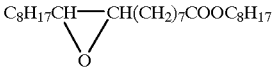

(Solv-2) Solvent

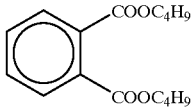

(Solv-3) Solvent

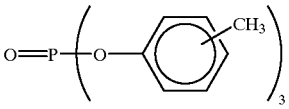

(Solv-4) Solvent (Solv-5) Solvent

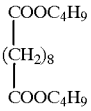

(Solv-6) Solvent

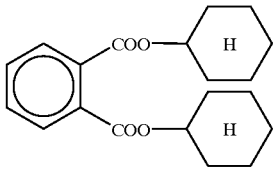

(Solv-7) Solvent

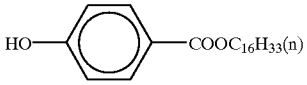

(Solv-8) Solvent

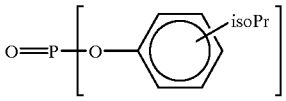

(Solv-9) Solvent

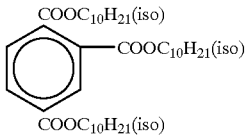

(UV-A) Ultraviolet Absorber
4/3/2/2 mixture by weight ratio of (1), (2), (3) and (4)
(1)
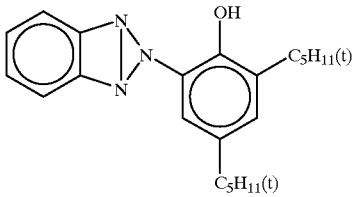
(2)
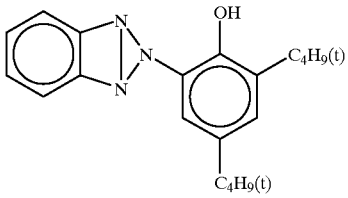
(3)
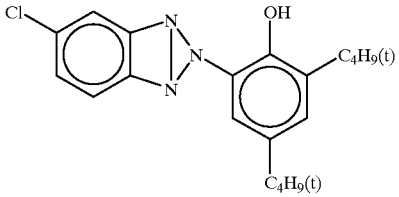
(4)
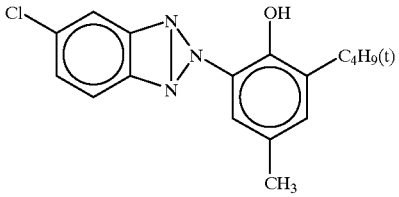
(UV-B) Ultraviolet Absorber
5/2/2/2 mixture by weight ratio of (1), (2), (3) and (4)
(1)
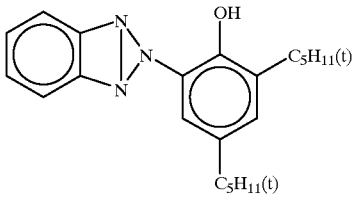
(2)
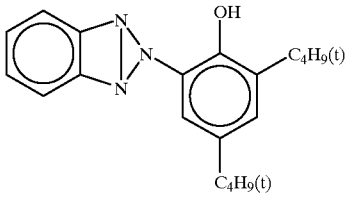
-continued
(3)
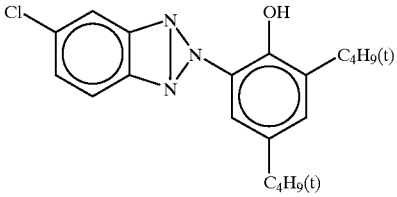
(4)
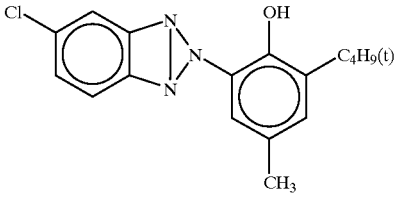
(UV-C) Ultraviolet Absorber
6/2/2/2/3 mixture by weight of (1), (2), (3), (4) and (5)
(1)
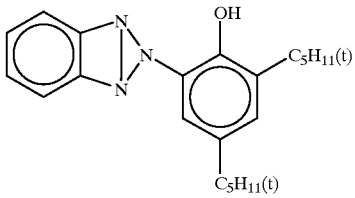
(2)
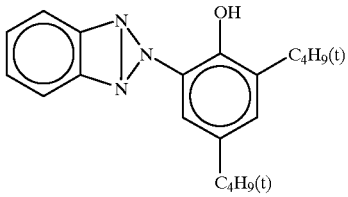
(3)
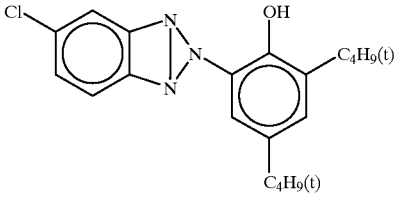
(4)
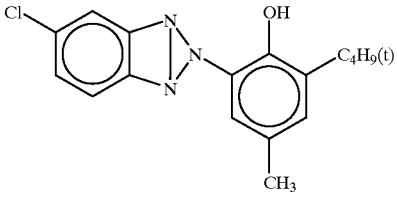
(5)
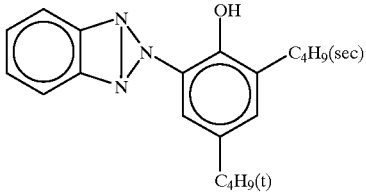

In the same manner as in the preparation of light-sensitive material (Sample 101) described above except for adding the polymer latex according to the present invention or a comparative polymer as shown in Table 2 below to the fifth layer (red-sensitive emulsion layer) to prepare light-sensitive materials designated Samples 102 to 121, respectively.

Each of the light-sensitive materials thus-prepared was exposed imagewise and then subjected to continuous development processing using a processing machine for color paper according to the processing steps shown below.

| Processing Step | Processing Temperature (° C.) | Processing Time (sec) | Replenishment Rate* (ml) | Tank Capacity (ml) |
|---|---|---|---|---|
| Color Development | 38.5 | 45 | 73 | 500 |
| Bleach-Fixing | 30–35 | 45 | 60 | 500 |
| Rinsing (1) | 30–35 | 20 | – | 500 |
| Rinsing (2) | 30–35 | 20 | – | 500 |
| Rinsing (3) | 30–35 | 20 | 370 | 500 |
| Drying | 70–80 | 60 | | |

| Color Developing Solution | Tank Solution | Replenisher |
|---|---|---|
| The composition of each processing solution was as follows | | |
| Water | 700 ml | 700 ml |
| Sodium Triisopropylene(β)-sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Brightening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 10.0 g | 13.0 g |
| N-Ethyl-N-(β-methanesulfon-amidoethyl)-3-methyl-4-amino-aniline Sulfate | 5.0 g | 11.5 g |
| Water to make | 1,000 ml | 1,000 ml |
| pH (25° C.) | 10.0 | 11.0 |

| Bleach-Fixing Solution | |
|---|---|
| tank solution and replenisher are the same | |
| Water | 600 ml |
| Ammonium Thiosulfate (700 g/liter) | 100 ml |
| Sodium Sulfite | 40 g |
| Ammonium Ethylenediaminetetraacetato Ferrate | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 4.8 |

*Replenishment rate per $m^2$ of the light-sensitive material
Rinsing was conducted in a 3-tank countercurrent system from rinsing (3) to rinsing (1).

Rinsing Solution (tank solution and replenisher are the same) Ion Exchange Water (each concentration of calcium and magnesium is 3 ppm or less)

Cyan reflective density at the Dmax area was measured with each sample just after the development processing. Then, each sample was immersed in CN-16N2 manufactured by Fuji Photo Film Co., Ltd. for 30 minutes in order to convert the leuco body of cyan dye which had been formed in part during the above development processing into the cyan dye. After the recoloring of leuco-body, cyan reflective density at the Dmax area was again measured.

Using these cyan reflective densities obtained just after the development processing and after the recoloring of leuco-body, a degree of the formation of leuco-body (i.e., blix discoloration) was determined in terms of a cyan density decreasing ratio set forth by the following formula:

$$\text{Cyan Density Decreasing Ratio} = \left(1 - \frac{D_A}{D_B}\right) \times 100$$

wherein $D_A$ denotes the cyan reflective density just after the development processing and $D_B$ denotes the cyan reflective density after the recoloring of leuco-body.

The results obtained are shown in Table 2 below.

TABLE 2

| Sample No. | Polymer: Polymer | Polymer: Amount Added ($mg/m^2$) | Cyan Density Decreasing Ratio (%) | Remarks |
|---|---|---|---|---|
| 101 | — | 0 | 15 | Comparative Example |
| 102 | P-1 | 35 | 3 | Present Invention |
| 103 | P-2 | 70 | 1 | Present Invention |
| 104 | P-2 | 35 | 3 | Present Invention |
| 105 | P-3 | 35 | 2 | Present Invention |
| 106 | P-4 | 35 | 3 | Present Invention |
| 107 | P-7 | 35 | 2 | Present Invention |
| 108 | P-9 | 70 | 2 | Present Invention |
| 109 | P-9 | 35 | 4 | Present Invention |
| 110 | P-12 | 35 | 2 | Present Invention |
| 111 | P-17 | 35 | 2 | Present Invention |
| 112 | P-20 | 35 | 2 | Present Invention |
| 113 | P-34 | 35 | 3 | Present Invention |
| 114 | Comparative Polymer a | 70 | 15 | Comparative Example |
| 115 | Comparative Polymer b | 70 | 12 | Comparative Example |
| 116 | Comparative Polymer b' | 70 | 10 | Comparative Example |
| 117 | Comparative Polymer c | 70 | 16 | Comparative Example |
| 118 | Comparative Polymer d | 70 | 12 | Comparative Example |
| 119 | Comparative Polymer e | 70 | 10 | Comparative Example |
| 120 | Comparative Polymer e | 35 | 12 | Comparative Example |
| 121 | Comparative Polymer f | 70 | 5 | Comparative Example |

TABLE 2-continued

| | | | | |
|---|---|---|---|---|
| 122 | Comparative Polymer f | 35 | 9 | Comparative Example |

Comparative Polymer a: Latex of n-butyl acrylate homopolymer
Comparative Polymer b: Latex of n-butyl acrylate/methacrylic acid (90/10) copolymer M = H (100)
Comparative Polymer b': Latex of n-butyl acrylate/methacrylic acid (90/10) copolymer M = H/Na (80/20)
Comparative Polymer c: Methacrylic acid homopolymer
Comparative Polymer d: Latex of 2-methoxyethyl acrylate homopolymer (described in JP-A-64-52136)
Comparative Polymer e: Latex of 2-methoxyethyl acrylate/acrylic acid (89.6/10.4) copolymer M = H (100) (described in JP-A-64-52136)
Comparative Polymer f: Water-soluble n-butyl acrylate/methacrylic acid (70/30) copolymer M = H/Na (20/80)

From the results shown in Table 2, it can be seen that color images having the high maximum density can be obtained without the substantial formation of leuco body of cyan dye after the development processing in case of using the polymer latex according to the present invention even in a small amount and that the polymer latexes of the present invention having the relatively high acid content defined above provide the unexpected and remarkable results in comparison with the conventional latexes having a low acid content and the homopolymer containing a —COOH group. Also, the latex of the present invention exhibits the superior effects as compared with the water-soluble copolymer having-the same composition.

Further, the polymer latexes according to the present invention provide the superior results same as the above in comparison with the comparative polymers when cyan couplers other than those set forth above are employed.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one silver halide emulsion layer, wherein said at least one silver halide emulsion layer contains at least one cyan dye forming coupler and at least one polymer latex represented by the following formula (I):

$$—(A)_x—(B)_y— \quad (I)$$

wherein A represents a repeating unit derived from at least one ethylenically unsaturated monomer having at least one —COOM group in its molecule, wherein M represents a hydrogen atom or a cation; B represents a repeating unit derived from at least one ethylenically unsaturated monomer which does not have said at least one —COOM group; and x and y represent weight percentages of A and B, respectively, x represents a number of from 25 to 85, y represents a number of from 75 to 15, and x+y=100.

2. A silver halide color photographic light-sensitive material as claimed in claim 1, wherein said at least one silver halide emulsion layer contains silver halide grains having a silver chloride content of 90 mol % or more.

3. A silver halide color photographic light-sensitive material as claimed in claim 1, wherein said at least one polymer latex is represented by the following formula (II):

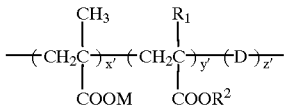

(II)

wherein $R^1$ represents a hydrogen atom or a methyl group; $R^2$ represents an alkyl group having from 1 to 8 carbon atoms or a cycloalkyl group; D represents a repeating unit derived from other ethylenically unsaturated monomer, M represents a hydrogen atom or a cation; and x', y' and z' each represents a weight percentage of each repeating unit, x' represents a number of from 25 to 60, y' represents a number of from 75 to 40, z' represents a number of from 0 to 30, and x'+y'+z'=100.

4. A silver halide color photographic light-sensitive material as claimed in claim 1, wherein a neutralization ratio of carboxylic acid group in said at least one polymer latex represented by the formula (I) is from 0 to 20%.

5. A silver halide color photographic light-sensitive material as claimed in claim 3, wherein a neutralization ratio of carboxylic acid group in said at least one polymer latex represented by the formula (II) is from 0 to 20%.

6. A method for preventing blix fading (or discoloration) of a silver halide color photographic light-sensitive material comprising imagewise exposing said material which comprises a support having provided thereon at least one silver halide emulsion layer, wherein said at least one silver halide emulsion layer contains at least one cyan dye forming coupler and at least one polymer latex represented by the following formula (I):

$$—(A)_x—(B)_y— \quad (I)$$

wherein A represents a repeating unit derived from at least one ethylenically unsaturated monomer having at least one —COOM group in its molecule, wherein M represents a hydrogen atom or a cation; B represents a repeating unit derived from at least one ethylenically unsaturated monomer which does not have said at least one —COOM group; and x and y represent weight percentages of A and B, respectively, x represents a number of from 25 to 85, y represents a number of from 75 to 15, and x+y=100; and developing and then bleaching or bleach fixing said material, thereby preventing color density loss due to conversion of cyan dye image to a leuco cyan dye.

7. A method for preventing blix fading (or discoloration) according to claim 6, wherein said at least one silver halide emulsion layer contains silver halide grains having a silver chloride content of 90 mol % or more.

* * * * *